United States Patent [19]

Fleury et al.

[11] 4,399,389

[45] Aug. 16, 1983

[54] TRAVELLING WAVE TUBE WITH COUPLED CAVITIES AND FOCUSING BY ALTERNATING PERMANENT MAGNETS AND AMPLIFYING SYSTEM COMPRISING SUCH A TUBE

[75] Inventors: Georges Fleury; Françis Payen, both of Paris, France

[73] Assignee: Thomson-CSF, Paris, France

[21] Appl. No.: 248,317

[22] Filed: Mar. 27, 1981

[30] Foreign Application Priority Data

Apr. 1, 1980 [FR] France ..... 80 07294

[51] Int. Cl.[3] ..... H01J 25/34

[52] U.S. Cl. ..... 315/3.5; 315/5.35; 315/3.6

[58] Field of Search ..... 315/5.34, 5.35, 3.6, 315/3.5, 39.3

[56] References Cited

U.S. PATENT DOCUMENTS

| | | | |
|---|---|---|---|
| 2,965,782 | 12/1960 | Weaver | 315/3.5 X |
| 3,324,339 | 6/1967 | Winslow et al. | 315/5.35 X |
| 3,527,976 | 9/1970 | Thal, Jr. | 315/3.6 |
| 3,885,192 | 5/1975 | Esterson et al. | 315/5.35 |
| 3,958,147 | 5/1976 | Triplett | 315/5.35 |
| 4,057,748 | 11/1977 | Davis | 315/5.35 |
| 4,103,207 | 7/1978 | Chaffee | 315/5.35 |

*Primary Examiner*—Saxfield Chatmon, Jr.
*Attorney, Agent, or Firm*—Roland Plottel

[57] ABSTRACT

In a travelling wave tube in which the delay line (1) is constituted by a sequence of double resonator cavities (15) alternating with the pole pieces (3) of the focusing system, the invention provides for the purpose of limiting the interception of electrons by the line an increase in the diameter of the magnetic material collars (30, 40) terminating said pieces, as well as the wall (16) of the cavities on the side of the tube axis. This increase takes place in stages, a collar (40) having the same diameter as the collar (30) which follows it in the beam propagation direction.

5 Claims, 3 Drawing Figures

TRAVELLING WAVE TUBE WITH COUPLED CAVITIES AND FOCUSING BY ALTERNATING PERMANENT MAGNETS AND AMPLIFYING SYSTEM COMPRISING SUCH A TUBE

BACKGROUND OF THE INVENTION

The invention relates to a travelling wave tube (TWT). The invention more specifically relates to a travelling wave tube with coupled cavities in which the beam is focused by a system of permanent magnets of the periodic permanent magnet type (PPM).

Such a focusing system of the so-called "alternating permanent magnet type" is constituted, as in the prior art, by rings pressed against one another around the axis of the tube and consisting alternately of magnets and pole pieces. In this case the pole pieces made from soft iron or some other material with a low reluctance are incorporated into copper cavity walls, so as to conduct the magnetic flux as near as possible to the electron beam.

As the thermal conductivity of soft iron is approximately 6 times lower than that of copper, the thermal resistance between the beam and the tube cooling circuit is at least 6 times higher when the pole faces are incorporated into the cavity walls. If it is also accepted that the current intercepted by the delay line is, all things being equal, 2 to 4 times higher in the case of focusing by permanent magnets than in the case of focusing by a solenoid, the continuous power which it is possible to apply to the tube and consequently the maximum high frequency power available at the output of such a tube is significantly lower than in the case of focusing by a solenoid. These high frequencies correspond to decimeter or centimeter waves, varying from a few gigahertz to more than 10 gigahertz. Towards the high frequency output of the tube the increase in the beam diameter can be such that, under the influence more particularly of the high frequency field of the cavities, the openings thereof melt under the impact of the intercepted electrons. This limits the power applied to the tube.

However, in spite of this the technology of travelling wave tubes is often directed towards the solution using permanent magnets for focusing the beam due to the convenience which it provides, more particularly from the standpoint of fitting focusing members and of the operation of the tube, due to the elimination of the continuous source necessary for supplying the solenoid.

BRIEF SUMMARY OF THE INVENTION

Therefore the invention relates to a travelling wave tube with focusing by permanent magents and pole pieces.

It relates to a travelling wave tube having a structure making it possible to prevent or at least reduce to a significant extent the aforementioned disadvantage concerning the maximum power which can be applied to the tube.

The invention also relates to amplifiers for high frequency using a tube according to the invention.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
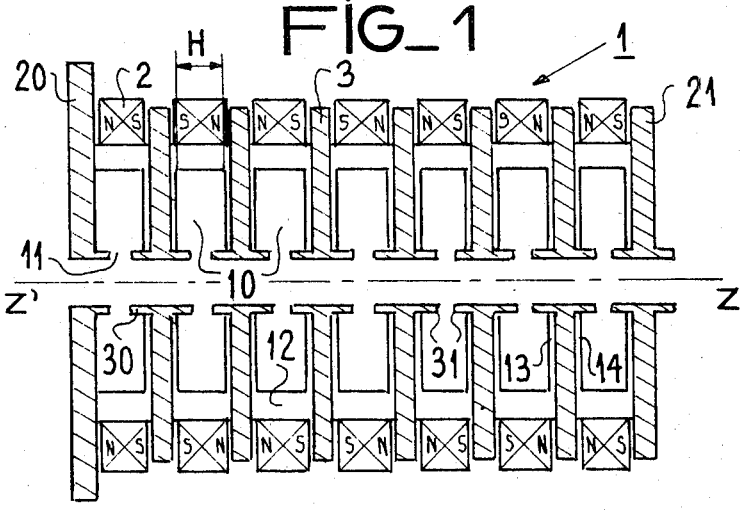
FIGS. 1 and 2 two diagrammatic sectional views of the central part of travelling wave tubes with coupled cavities according to the prior art.

FIG. 1 shows an embodiment of a travelling wave tube with coupled cavities according to the prior art. This, and the other drawings, shows the central part of the tube, constituted by the delay line 1, which is the source of the electromagnetic wave which, in operation, interacts with the not shown electron beam propagating along axis Z'Z between a cathode system by which it is produced and located in the left-hand part of the drawing, and a collector by which it is intercepted located beyond delay line 1 to the right of the drawing. These elements are not shown in the drawings, because they are not necessary for the understanding of the invention.

The delay line 1 is constituted by coupled cavities 10 arranged in a regular succession along axis Z'Z. These cavities are resonator cavities of the re-entrant type known in connection with ultra-high frequencies and revolving about the axis and open at 11 in the vicinity thereof for coupling to the beam. The prior art cavity coupling means are not shown in the drawings. The permanent magnets 2 are arranged around the said cavities and pole pieces 3. The latter are in the form of washers and are provided with a flange or collar 30. The aligned collars define the space in which the beam is propagated and form the re-entrant angle of cavities 10. Their edges which are generally tapered constitute the nose 31 of said cavities. These nose can also be straight edged as shown in the drawings. Pole piece 3, including collar 30 is made in one piece from a material with a low reluctance for the magnetic field of the magnets, e.g. of soft iron. As indicated in the drawing the magnets are alternately arranged south-north and north-south. Finally two members 20 and 21 bound the focusing system at its two ends.

In FIG. 1 the cavities 10 are peripherally limited by a cylindrical wall 12 in contact with magnets 2 and laterally limited by planar walls 13, 14. All these are made from copper, which is a good electrical and thermal conductor, the pole pieces 3 being inserted between two successive lateral or side walls. These walls are shown without haching in the drawings for reasons of clarity.

Due to the use of copper this arrangement ensures a good removal of the heat produced in operation in the tube towards an external and not shown cooling system, which can be positioned in different ways around the tube.

However, all things being equal, it has the disadvantage of reducing the height H of the cavities, in the amount of the thickness of the copper side walls 13, 14 and, for a given frequency, makes it necessary to increase their internal diameter that is the diameter of collars 30, which reduces the coupling of the cavities with the beam and the performance characteristics of the tube.

Figure 2:
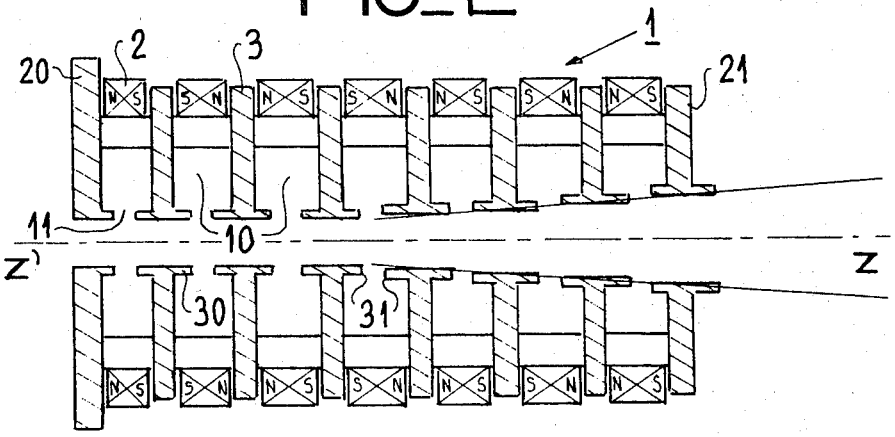

In another arrangement according to the prior art shown in FIG. 2 this disadvantage is obviated by using the actual pole pieces 3 to form the side walls of cavities 10. This prevents the reduction of height H, but heat removal from the delay line is made more difficult. To reduce the heat quantity to be removed, the diameter of collars 30 is increased on approaching the end of the tube positioned on the side of the collector, so as to reduce the interception of the beam by these, particularly by their edges or openings 31, which have a high resistance to the heat flow. The space available for the beam widens towards the collector in accordance with the oblique lines. However, the limitation is then imposed by the necessity of retaining a good coupling between the beam and the wave. The necessary increase in the diameter of collars 30 is generally between 10 and 25% in this case.

In another arrangement known from the prior art the pole pieces such as 3 are separated by two cavities 10. A soft iron collar is then also provided on the wall common to the coupled cavities placed between two successive pole pieces. In this new arrangement the removal of heat is made less difficult by the large proportion of copper involved in the formation of the delay line. The collar terminating the copper wall in question constitutes a floating pole piece leading to the harmonic 3 enrichment of the magnetic field in the space in which the electron beam is propagated. The magnetic field produced at the center of the tube by the system of magnets and pole pieces has a value which is a periodic function of the abscissa along axis Z'Z. The harmonic in question is that of said periodic spatial distribution. Under certain conditions this leads to a reduction in the undulations affecting the diameter of the beam along its path and consequently the risks of interception of the beam by the delay line.

Figure 3:
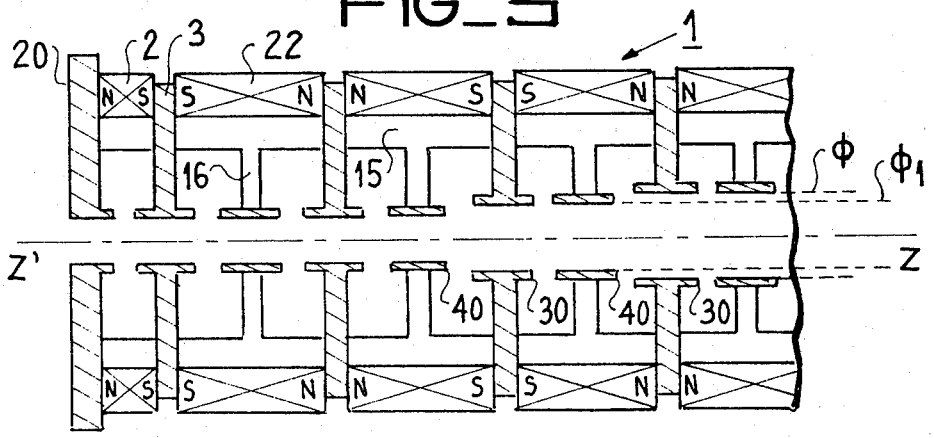
FIG. 3 an identical view of a travelling wave tube with coupled cavities according to the invention.

FIG. 3 shows an embodiment of the delay line of tubes according to the invention. As in the prior art the cavities between which are gripped pole pieces 3 are duplicated. In the drawing they are designated by reference numeral 15 and their central wall by reference numeral 16.

The pole pieces and the central wall in each case carry a collar, like collar 30 in the preceding drawings, said collar being made from soft iron or a material with a low reluctance. The magnets 22 have proportionate lengths between the two pole pieces 3. The collars belonging to a pole piece 3 are designated by a reference numeral 30 and those located at the end of the copper walls 16 are designated by the reference numeral 40.

To reduce the interception of electrons the diameter of collars 30 increases in the beam propagation direction and particularly in the final part of the line.

According to the invention this increase takes place in stages, every other collar, whereby collar 30 of one of the pole pieces and collar 40 of the central wall of the following two cavities on the beam path having the same diameter. Thus, the space available to the beam in its path to the collector is increased and in the section shown the diameter of this space varies from $\phi_1$ to 100.

Each of the collars 30 is protected against interception of electrons by the preceding collar 40. To a certain extent the collar 40 casts a shadow on the following collar 30.

Maximum interception occurs on collars 40 in contact with a generally thick copper member 16, permitting a good removal to the oustide of the heat received by the line.

All things being equal, with centimeter waves there is an improvement of 1 dB on the output level of a delay line tube according to the prior art of FIG. 2 when equipped with the improvement according to the invention.

The invention can be used in travelling wave tube amplifiers for telecommunications, particularly by satellite.

What is claimed is:

1. A travelling wave tube comprising a cathode system producing an electron beam propagating along an axis and a collector by which the beam is intercepted, and, arranged around said axis between the cathode system and the collector, a delay line formed by successive re-entrant resonator cavities centered on the axis and coupled to one another, said tube being provided with a system for focusing the electron beam having alternating permanent magnets and constituted by magnetized collars, surrounding the outer wall of the cavities, and pole pieces gripped between the cavities and alternating therewith, at a rate of one pole piece every two cavities, said pole pieces being terminated on the side of the axis by a collar centered on said axis, the wall common to two successive cavities being in a material having a thermal conductivity higher than the pole pieces and being itself terminated on the same side by a similar collar made from a magnetic material, these collars forming the re-entrant part of the cavities, whereby transversely with respect to the axis the collars limit the space in which the beam is propagated, wherein the diameter of these collars increases in the beam propagation direction, particularly in the final part of the line, said increase taking place in stages, every other collar, the collar of one pole piece and that of the common wall which follows it having the same diameter.

2. An amplifier system comprising at least one tube according to claim 1.

3. A travelling wave tube comprising:

(a) a cathode system producing an electron beam;

(b) a collector;

(c) a delay line formed by successive re-entrant resonator cavities coupled to one another and arranged between the cathode system and the collector around the axis of the electron beam;

(d) a system for focusing the electron beam comprising alternating permanent magnets surrounding the outer wall of the cavities and pole pieces in magnetic material gripped between the cavities and alternating therewith at a rate of one pole piece every two cavities, said poles pieces and a wall common to two successive cavities being made from material having a thermal conductivity higher than the material of the pole pieces; and pole pieces and common walls being terminated on their side nearest the axis by a collar made from a magnetic material, and the diameter of the location of these collars increases in the beam propagation direction, at least in the final part of the line, said increase taking place in stage, the collar of one pole piece and that of the common wall which follows it having the same diameter.

4. An amplifier system comprising at lease one tube according to claim 3.

5. An amplifier according to claim 3 wherein said material of higher conductivity is approximately six times higher.

* * * * *